United States Patent [19]

Dyer et al.

[11] Patent Number: 4,997,011

[45] Date of Patent: Mar. 5, 1991

[54] HAND HELD TIE TENSIONING AND CUT-OFF TOOL

[75] Inventors: Edward Dyer, Germantown; William K. Lueschen, Cedarburg, both of Wis.

[73] Assignee: Tyton Corporation, Milwaukee, Wis.

[21] Appl. No.: 463,421

[22] Filed: Jan. 11, 1990

[51] Int. Cl.[5] ..... B21F 9/02

[52] U.S. Cl. ..... 140/93.2; 140/123.6

[58] Field of Search ..... 72/93 A, 93.2, 123.6

[56] References Cited

U.S. PATENT DOCUMENTS

| | | |
|---|---|---|
| Re. 26,492 | 11/1968 | Caveney et al. . |
| Re. 29,973 | 4/1979 | Paradis . |
| Re. 30,996 | 7/1982 | Pobuta . |
| 3,284,076 | 11/1966 | Gibon . |
| 3,332,454 | 7/1967 | Lawson et al. . |
| 3,344,815 | 10/1967 | Lawson et al. . |
| 3,589,406 | 6/1971 | Moberg . |
| 3,610,296 | 10/1971 | Kabel . |
| 3,645,302 | 2/1972 | Caveney et al. . |
| 3,661,187 | 5/1972 | Caveney et al. . |
| 3,712,346 | 1/1973 | Noorily . |
| 3,735,784 | 5/1973 | Obuch et al. . |
| 3,752,199 | 8/1973 | Fekete . |
| 3,782,426 | 1/1974 | Morgan et al. . |
| 3,830,263 | 8/1974 | Benfer . |
| 3,853,155 | 12/1974 | Kabel . |
| 3,865,156 | 2/1975 | Moody et al. . |
| 3,993,109 | 11/1976 | Fortsch . |
| 4,064,918 | 12/1977 | Pobuta et al. . |
| 4,081,002 | 3/1978 | Violi . |
| 4,093,005 | 6/1978 | Eberhardt et al. . |
| 4,129,157 | 12/1978 | Sciolotto . |
| 4,192,358 | 3/1980 | Bone . |
| 4,252,158 | 2/1981 | McDade . |
| 4,390,047 | 6/1983 | Kaneko . |
| 4,410,019 | 10/1983 | Suzuki . |
| 4,499,928 | 2/1985 | Furutsu . |
| 4,548,242 | 10/1985 | Paradis . |
| 4,793,385 | 12/1988 | Dyer et al. . |

*Primary Examiner*—Lowell A. Larson

*Attorney, Agent, or Firm*—Lockwood, Alex, FitzGibbon & Cummings

[57] ABSTRACT

A hand held tool for applying high tension to cable ties and severing the cable tie tail is provided and includes means for positioning the cable tie tail at an upward angle within the tool, linear reciprocating means for tensioning the cable tie tail, severing means to sever the tie tail flush with the cable tie head upon the attainment of a preselected tension level in the tie tail, tie releasing means for releasing the severed tie tail from the tensioning means actuating means which operatively connects the tensioning and severing means and means for applying a restraining force to the actuating means to restrain the actuating means from operation until the preselected tension is achieved in the cable tie tail, whereupon the actuating means actuates the severing means to sever the tie tail. An operative connection which links the tie tensioning means to the actuating means is located within the tool housing above the return spring which reduces the likelihood of the cable ties being over tensioned.

40 Claims, 7 Drawing Sheets

HAND HELD TIE TENSIONING AND CUT-OFF TOOL

BACKGROUND AND SUMMARY OF THE INVENTION

The present invention relates generally to hand held tensioning and cutting tools, and particularly to an improved and reliable hand held tool for reliably applying high tension to flexible cable ties and cutting the tie tails thereof without overtensioning the cable tie.

Flexible cable ties are widely used in a variety of applications to bundle multiple wires or cables. Such cable ties typically include an elongated tail portion which is threaded through an integral head portion to encircle the wires, and the tie tail is drawn through the cable tie head to tightly bind the cables into a bundle. After the tie is tensioned around the cable bundle, the excess length of the tie tail extending out of the head portion is then severed close to the head by the tool.

One disadvantage of some presently available tie tensioning and cutting tools is that those tools require their operators to apply excessive forces to their triggers for cutting the ties which leads to tool operator fatigue after only a relatively small amount of cables ties have been installed by the operator. Other tie tensioning and cutting tools have triggers mechanically linked to the tensioning and severing mechanisms in a manner so that the actual tension attained in the cable tie immediately prior to severing of the cable tie tail often increases above the preselected value due to the movement of the linkages during the tensioning operation. When excessive tensioning forces are applied to the cable tie tail portions of the cable tie tail may be stretched above the elastic limit of the cable tie material prior to severing.

The present invention is directed to a hand held tensioning and severing tool which avoids the aforementioned shortcomings In accordance with an important aspect of the present invention, an improved hand held tie tool is provided which includes reciprocating means for applying high tension to the cable tie tail, means for severing the cable tie tail from the cable tie head when a preselected high tension is attained in the cable tie and operatively connected to the reciprocating means and an actuating means unrestricted in its movement by the tool housing, the movement of which actuates the tie severing means.

In accordance with another principal aspect of the present invention an improved tie discard means is provided in the form of a plurality of angled surfaces disposed near the front of the tool proximate to the tool tie entry slot which direct the cable tie tail upwardly away from the tool when inserted into the tool.

In accordance with still another aspect of the present invention, a means for reliably applying high tension to cable ties is provided by operatively connecting a tensioning means directly to an actuating means, the operative connection being located above the tool trigger and forwardly of a trigger return means which reduces the amount of opposing force applied to the actuating means by the return means, thereby reducing the stroke of the tool required to tension to the cable tie.

Accordingly, it is a general object of the present invention to provide an improved hand held tie tensioning and severing tool capable of reliable operation which consistently severs the cable tie tail at high tension levels without exceeding the maximum desirable tension level for the cable tie.

Another object of the present invention is to provide a selective tensioning assembly in a hand held tie tensioning and severing tool wherein a number of distinct high tie tension values can reliably be obtained.

Still another object of the present invention is to provide an improved hand held tie tensioning and severing tool which applies high tension to the cable tie tails of successively tensioned cable ties consistently at uniform tension levels irrespective of how the tool trigger is held by the operator.

Another object of the present invention is to provide an improved hand held tie tensioning and severing tool for reliably tensioning cable ties by gripping either a flat surface or a serrated surface of a cable tie tail.

Yet another object of the present invention is to provide a means for orienting the tie tail in the tie gripping means which improves the ability of the tool to discard the same after the tie tail has been severed.

Another object of the present invention is to provide a mechanical linkage for a tie tensioning tool which reduces the stroke of the tensioning means required to apply tension to the cable tie.

These and other objects, features and advantages cf the present invention will be clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENTS

Figure 1:
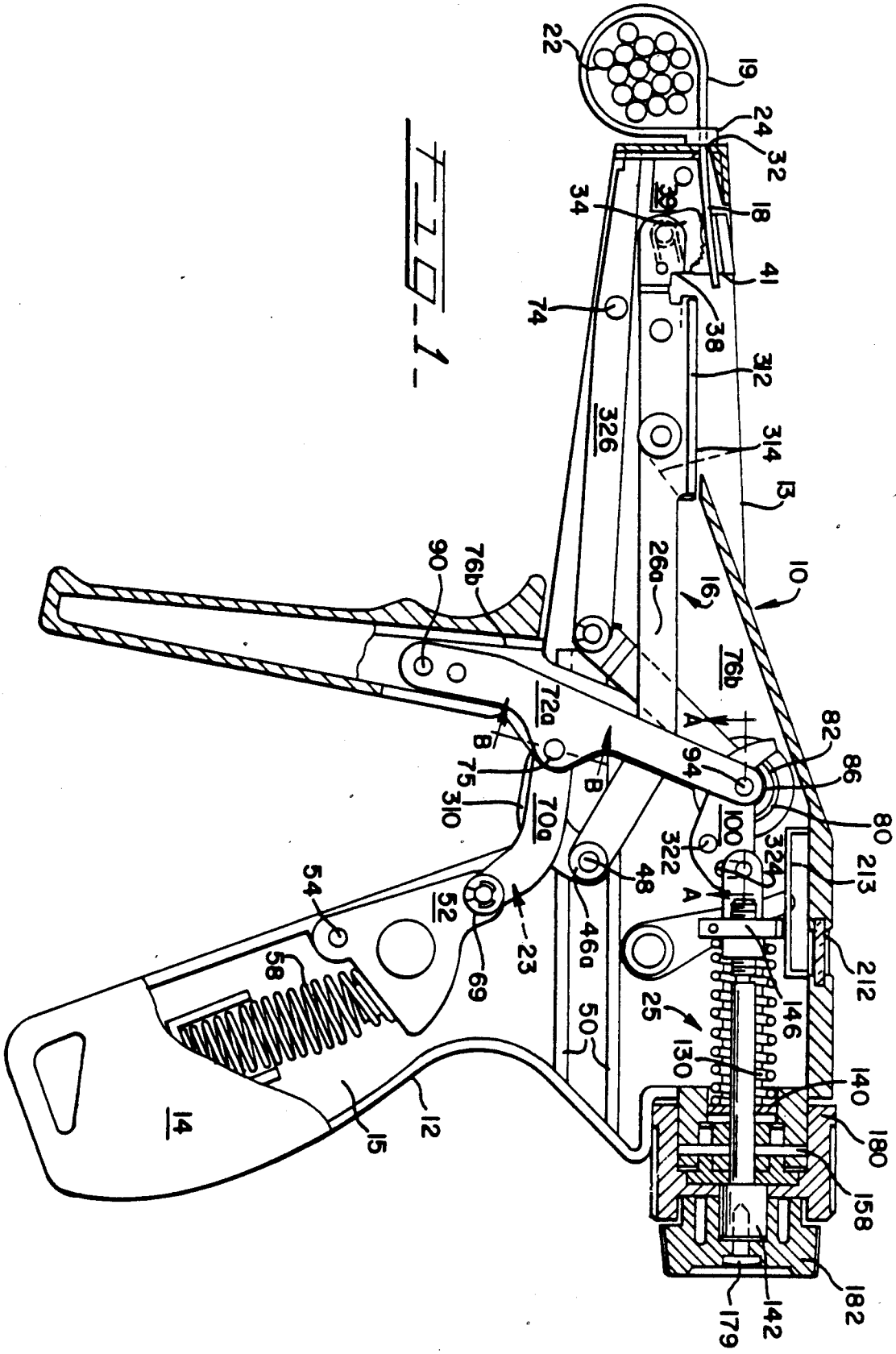
FIG. 1 is a side elevational view of a preferred embodiment of a hand-held tool constructed in accordance with the principles of the invention having a portion of the tool housing cutaway showing the internal parts and mechanisms of the tool.
Figures 2, 2A:
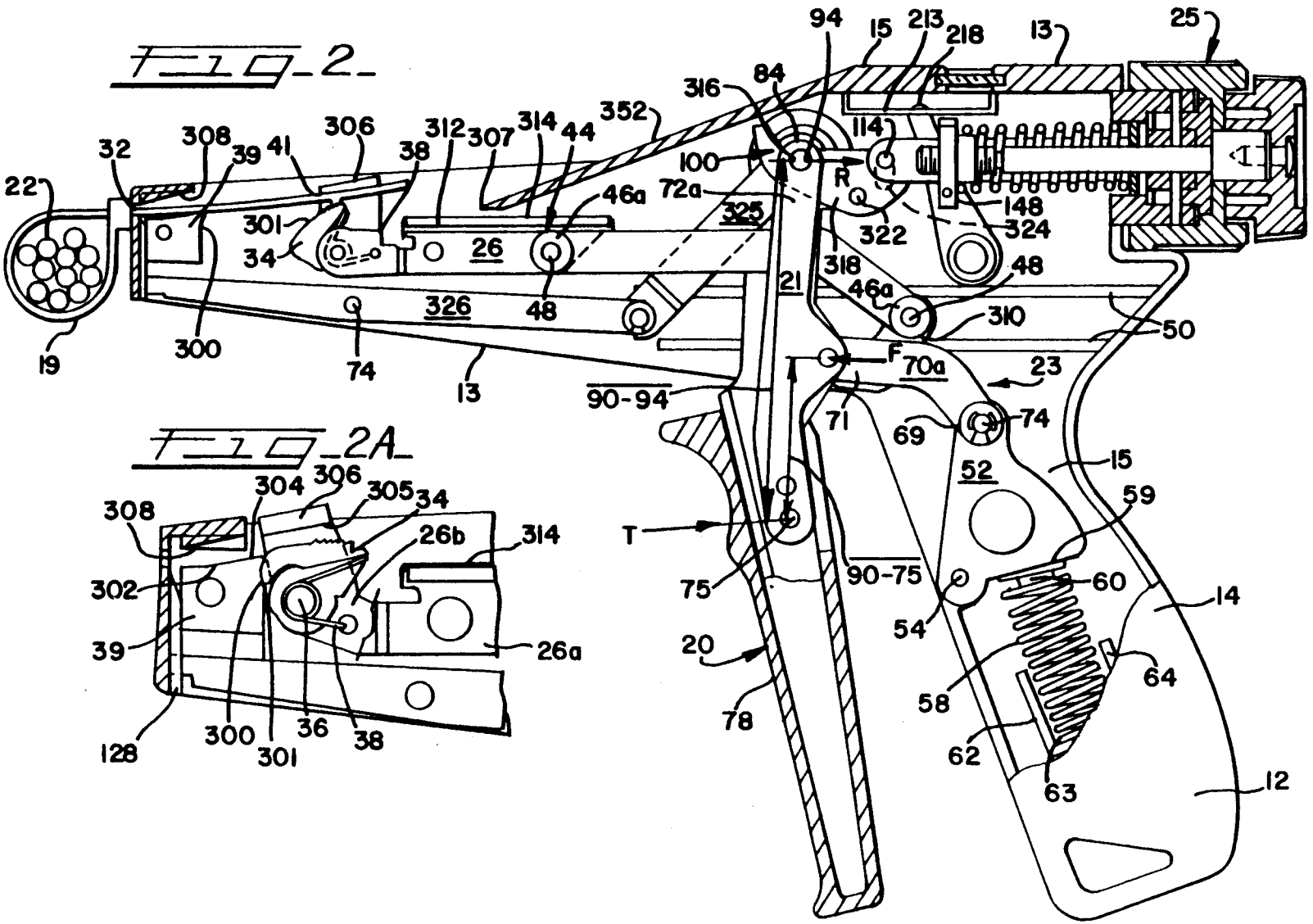
FIG. 2 is a cutaway view of the tool similar to FIG. 1, showing the tool after the trigger has been depressed and tension has been applied to the cable tie tail.
FIG. 2A is an enlarged sectional view of the nose section and tie gripping mechanism of the tool with a portion of the near pawl link removed.
Figures 3, 3A:
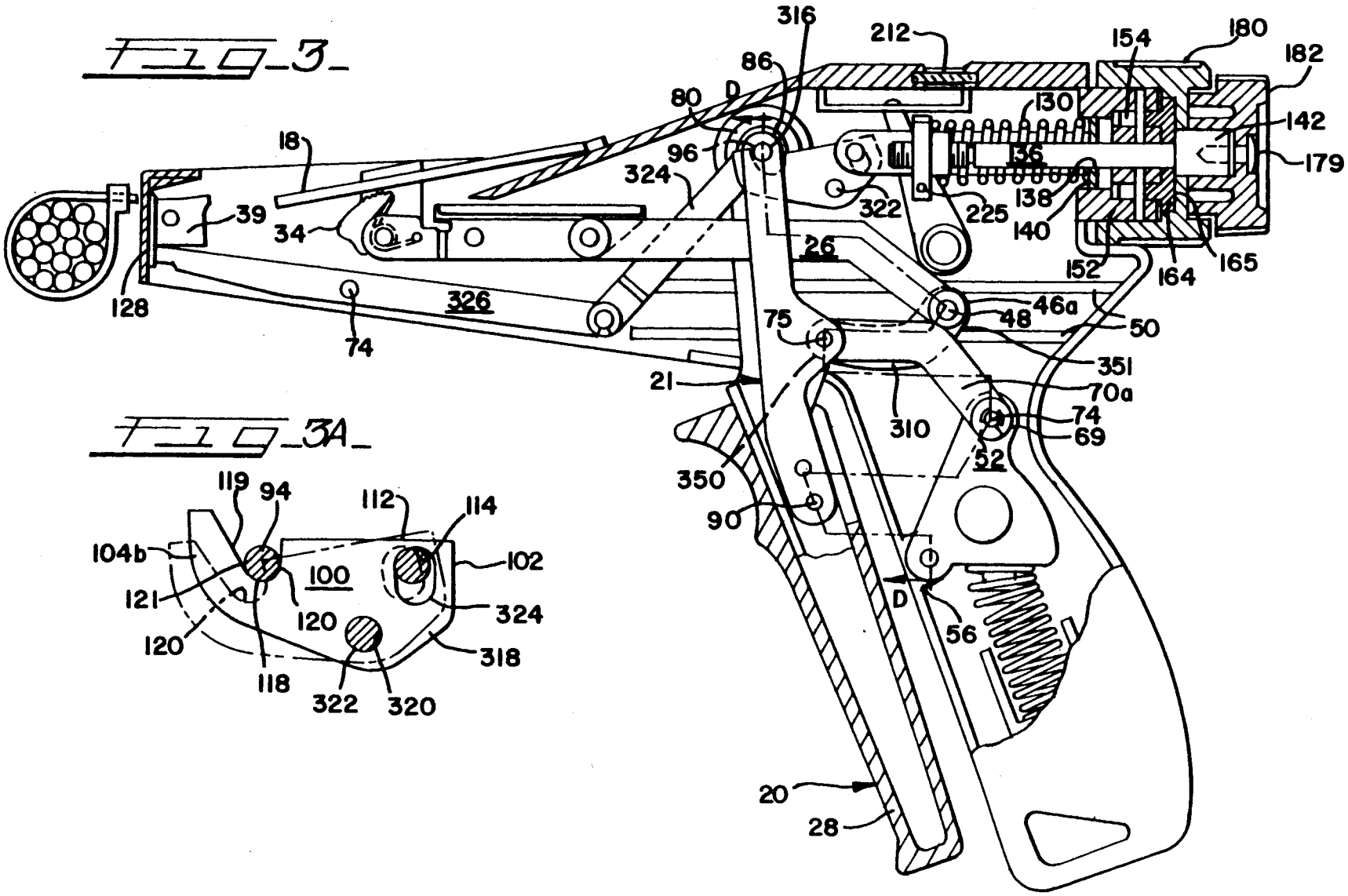
FIG. 3 is a cutaway view of the tool similar to FIG. 2, showing the tool immediately after the cable tie tail has been severed near the tie head.
FIG. 3A is a side elevational view of the cam mechanism used in the tool shown in FIGS. 1-3.

Referring now to the drawings, and in particular FIGS. 1-3, a preferred embodiment of a tie tool 10 incorporating the principles of the present invention is shown as having a housing 11 in the shape of a pistol or gun having a handle portion 12 and a barrel portion 13. In FIGS. 1-3 one sidewall 14 of housing 11 has been cut away to show the other housing sidewall 15 and the internal parts and mechanism. The tool 10 generally contains a reciprocating tensioning member 16, formed by joining a pair of elongate pawl links 26 together, extending along the length of barrel 13 with a means 17 for gripping the tie tail 18 of a cable tie 19 located at the front end of the tensioning member 16. The tensioning member 16 is operatively connected by means of a mechanical linkage 23 to a manually operated trigger 20 which houses an actuating assembly 21. Actuating assembly 21 is also operatively connected to the selective adjustment tensioning mechanism 25 near the rear portion of the tool barrel 13 and a tie severing mechanism 28 disposed in the frontal portion of the tool barrel.

Cable Tie Gripping Mechanism

Turning now to the details of the tensioning and gripping mechanism, the front of the tool barrel 13 is provided with a nose slot 32, through which the tool operator passes the tie tail 18 of a cable tie 19 with the serrations of the tie 19 facing up or down, after the tail 18 has been first passed around a bundle of wires 22 and threaded through the cable tie head 24. The tie tail 18 engages a tie-gripping pawl 34 having a plurality of tie tail gripping teeth 350, which pawl 34 is rotatably held on a shaft 36 extending between the forward open ends of the two pawl links 26 by pawl shaft 36. The pawl teeth 350 are spaced apart and angled upwardly from the pawl 350. The pawl teeth 350 further have a depth and sharpness sufficient to enable the pawl 34 to grip the cable tie tail 18 on either a flat or serrated side for tensioning purposes. The pawl 34 is biased for forward rotation (counterclockwise) about shaft 36 by a torsion spring 38 which engages the pawl shaft and the pawl 34. The pawl 34 applies a gripping pressure on the tie tail 18 held in a tie passageway 41 between a tie guide plate 306 and the pawl 34 to define the passageway 41 therebetween. By squeezing the tool trigger 20 the operator applies a rearward force to the pawl links 26 by way of mechanical linkage 23, including a high-tension link 310, thereby drawing the tie tail back toward the rear of tool 10 and tensioning the tie 19 around the wires 22.

Pawl Return and Tie Discard Mechanism

When the tool is in its initial position (FIG. 1.) the tensioning member 16 (and pawl links 26) are biased into their forwardmost extent within the tool barrel 13 by a return spring 58 located in the handle 12. In this position the pawl 34 abuts nose guide block 39. Importantly, the rear face of the nose guide block 39 is provided with a "dished" surface or arcuate depression 300 which engages the front face 301 of the pawl 34 when the tool trigger is released. The pawl front face 301 is configured complimentary to that of the nose block depression 300 so that the depression 300 and the pawl front face 301 interact after the tie tail has been severed and the pawl links 26 are returned to the front of the tool by the operator releasing pressure on the trigger 20. When the pawl links 26 are returned, the pawl front face 301 engages and rides on the depression 300 to rotate rearwardly (clockwise in FIGS. 1-3) to open the tie passageway 41 between the pawl 34 and tie guide plate 40, thereby allowing the severed tie tail to easily fall out of the pawl tie passageway 41.

Cable Tie Orienting Mechanism

In one important aspect of the present invention and as best shown in FIG. 2A, the nose guide block 39 includes a first angled surface 302 which is preferably angled slightly upwardly by means of a tie ramp 304 disposed on its rearward end and positioned in the path of the nose slot 32. One of the pawl links **26*b* has a tie guide plate 306 formed integrally therewith which includes a second angled surface 305 extending over the pawl 34. The tie guide plate 306 is also angled upwardly, preferably at the same angle as the nose guide block tie ramp 304. The top of the nose guide block 39 may also be provided with a third angled surface 308 located above the nose block guide ramp 304 generally parallel to it, and having the same angle as the first angled surface 302. These multiple angled surfaces cooperate to orient the tie tail into a discard position in that they combine to urge the tie tail 18 upwardly when the tie tail 18 is inserted into the nose slot 32 of the tool. The tie tail 18 is maintained in its upward angle at the beginning of the tensioning stroke, through the tension stroke and subsequent severing of the tie tail 18. By maintaining the tie tail 18 at the upward angle, the likelihood that the tie tail will find its way into the small clearance 307 between the tool tie tail engagement face 309 and the top cover plate 312 of the pawl links 26 and jam the tool is greatly decreased. As further assurance against severed tie tails entering the clearance 307, a spring steel shield 314 may be provided to cover the pawl link cover plate 312. The shield preferably has a smooth finished surface which deflects any tie tail 18 into contact with the barrel engagement face 352, rather than the clearance 307**.

Cable Tie Tensioning Mechanism

The pawl links 26 are restricted to substantially reciprocatable linear movement within the tool housing 10 by guide means 44, shown as circular roller bearings **46*a,b* mounted on pin shafts extending outwardly from and transverse to the pawl links 26. These bearings 46*a,b* ride within guide tracks 50 which extend for a preselected distance on the interior surface 43 of the housing sidewalls 14 & 15 and guide the tensioning member in its movement within the tool barrel 13**.

The pawl tensioning links 26 are operatively connected to a tool actuating assembly 21 by way of a mechanical linkage 23. The two pawl links 26 are joined to the two actuating links **72*a* & 72*b* by way of a high tension link 310 which is connected at one end thereof to the two pawl links 26 by a pin 48. Two roller bearings 46 engage the pin 48 on opposite sides thereof and ride within two tool guide tracks 50. The high tension link 310 is connected at its other end the two actuating links 72*a* & 72*b* by means of a pivot pin 75**. The actuating links 72a & 72b are held between two portions of the trigger 20.

A handle link 52 is pivotally mounted within the tool handle 12 by a pivot pin 54 seated in a housing boss 56 in the tool sidewalls. A return spring 58 is provided which engages the lower end 59 of the handle link 52 and provides a force sufficient enough to return the trigger 20, the pawl links 26 and the pawl 34 back to the front of the tool barrel 13 after the tie tail 18 has been severed. When so returned, the arcuate leading edge at the pawl 34 will engage the nose guide block depression 300 and right itself into a tie clearance position, thereby releasing any pressure on the severed tie tail. The tie tail thereupon falls out of the tie passageway 41. The return spring 58 engages a tongue 64 at the handle link bottom 59 and is held under compression in a slot 62 between the handle link 52 and the slot base 63. The slot 62 is formed by walls 64 which protrude inwardly from the tool housing sidewalls 14 & 15. Return spring 58 also provides a constant force, approximately equivalent to the return spring constant, to partially resist the operator applied trigger force during tensioning. This resistance force is transmitted to the handle link 52 and translated therethrough to the two short links 70a and 70b, and then to the actuating links 72a and 72b held within the trigger 20 at pivot pin 75.

The handle link 52 is operatively connected to the trigger 20 and the actuating assembly 21 by a pair of short links 70a & 70b shown in FIGS. 1-3 as having a generally downward dogleg configuration. The short links 70a & 70b are secured at their rearward ends 69 to the handle link 52 by pivot pin 74 and at their forward ends 71 to actuating links 72a & 72b by a pivot pin 75. Pivot pin 75 forms a balance point or fulcrum for the operating forces of the tool 10. The short links 70a & 70b transmit the constant spring force of return spring 58 to the trigger 20 and actuating assembly 21.

High Tension Link

In another important aspect of the present invention the tool 10 is provided with a high tension link 310, shown in FIGS. 1-3 as having a generally upward dogleg configuration. The high tension link 310 is connected at its forward end 350 to the actuating links 72a & 72b and short links 70a & 70b by the pivot pin 75, while the rear end 351 thereof is connected to the ends of the pawl links 26 by pivot pin 48. Importantly, this high tension link pivot 310 transmits the tie resistance force directly to the actuating links 72a & 72b, rather than through the handle link 52. When the trigger 20 is depressed, the upper portion of the high tension link 310 slides backward in guide tracks 50, and draws the pawl links 26 rearwardly and applies a tensioning force to the cable tie 19.

The present invention eliminates any connection between the top of the handle link 52 and the pawl link 26, and instead operatively connects the pawl links 26 to the actuating links 72a, 72b by way of the high tension link 310. The operative connection 348 between the pawl link 26 and the high tension link 310 is positioned slightly forwardly of the handle link pin connection 74, which results in a shortened stroke of the tool, that is, the rearward distance which the pawl 34 travels to sever the tie tail 18. With the high tension link 310, the opposing force generated within the handle link 52 (by both the return spring 58 and the tie tensioning force) is not transmitted to the actuating links 72a & 72b by the handle short links 70a & 70b. Rather, the tie tension force is now moved out to the end of the pawl links 26 at shaft pin 48. Thus, the tie tensioning force applied to the actuating links 72a & 72b by the high tension link 310 is reduced because the distance between the trigger actuating assembly pin connection 90 and the pawl link-high tension link 348 is larger, than if the handle link were connected to the pawl links, resulting in a longer moment arm from pin 90, thereby reducing the force.

The pivot pin 75 connection between the short links 70a, b, and the actuating links 72a,b is located between the cam follower 94 and the trigger pivot pin 90 and provides a force fulcrum for the restraining force R and the trigger force T (FIG. 2). The pivot point 75 is preferably located at approximately 40% of the distance from trigger pivot pin 90 to the cam follower 94, that is, the length of a line segment drawn between 90-75 on the actuating link is 40% of the length of a line segment drawn between 90-94. A 60:40 mechanical advantage is obtained by this relationship and a proportionally smaller tension spring 130 can be used in the tool than if the pivot point 75 were to be located at 50% (or greater) of the distance along trigger line 90-94. Consequently a tension spring 130 having a relatively smaller spring constant can be used in the tool and importantly, the force or torque required by the operator to turn the tension selection knob 180 to select a desired tension is considerably reduced.

The Actuating Assembly

Figure 8A:
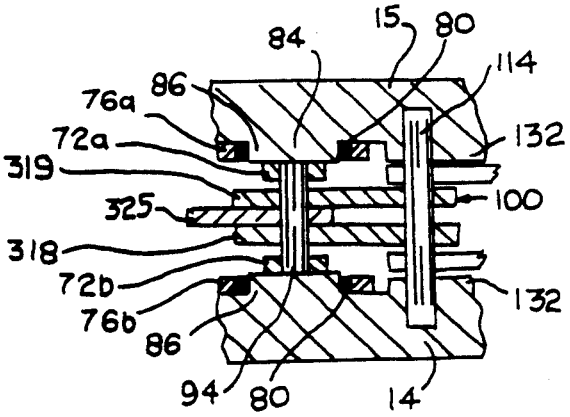
FIG. 8A is a sectional plan view taken along line A—A in FIG. 1.
Figure 8B:
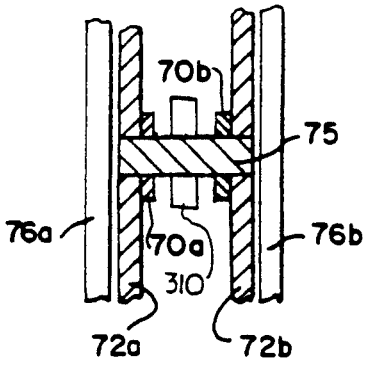
FIG. 8B is a sectional view taken along line B—B in FIG. 1.

Examining the trigger 20 and the actuating assembly 21 in greater detail, it can be seen that the actuating assembly comprises a pair of identical elongate actuating links 72a and 72b which are held in the trigger 20 between two elongate trigger link portions 76a and 76b which are enclosed by a flexible trigger boot 28. Trigger links 76a and 76b extent upwardly from the base of the trigger 20 into the barrel 13 where they are rotatably joined to the housing sidewalls 14 & 15 by way of trigger bearings 80. (FIG. 8A.) The trigger bearings 80 are held within a circular opening 82 in the top portion of each of trigger links 76a,b. Trigger bearings 80 are preferably substantially circular and rotatably engage circular bosses 84 which extend inward from the tool sidewalls 14, 15 to form bearing hubs 86 around which the trigger links 76a,b and bearings 80 freely rotate.

Figure 8C:
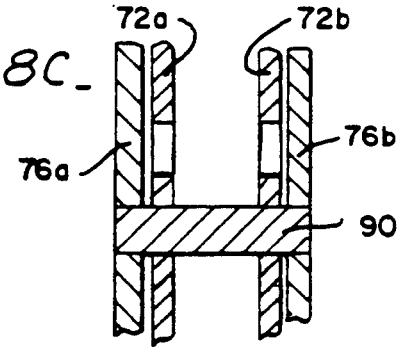
FIG. 8C is a sectional view taken along line C—C in FIG. 1.

The two actuating links 72a & 72b each have a pivot pin hole 88 formed in their lower ends 89 to receive a trigger pivot pin 90 therein which extends between the two trigger links 76a and 76b to operatively connect the trigger 20 and the actuating assembly 21. (FIG. 8C.) The trigger 20 is pivotally fixed to the housing 11 by bearing hubs 86, therefore trigger pivot pin 90 always defines the same arc of rotation around the central axis of the bearing hub 86. As will be explained below, when the operator actuates the severing mechanism 28 (FIG. 3), the actuating links 72a and 72b pivot about a force fulcrum F located at pivot 75 but do not pivot around the center of the bearing hub 86.

At the top of the trigger and the actuating links 72a and 72b, a cam follower 94 is provided in the form of an elongate shaft held in the actuating link pivot pin holes 316 between the housing sidewalls 14, 15 in a manner which does not restrict the movement of the actuating links 72a & 72b within the tool housing. The cam follower 94 is positioned by the actuating links 72a & 72b and the cutoff cam 100 between the housing two opposing bearing bosses 86.

A cutoff cam 100 (FIG. 3A) provides a means for actuating the severing mechanism 28 when a preselected tension is reached in the tie tail 18. Cutoff cam 100 is preferably formed from two identical metal cam blanks 318, 319 from which two generally parallel cam arms 104 extend to form a cam yoke 106. The cutoff cam 100 is pivotally mounted in the barrel 13 by way of a cutoff cam pivot shaft 108 fixed to the tool housing 11 extending between the housing sidewalls 14, 15. Cam pivot shaft 322 is engaged in a pivot hole 320 formed in the lower middle portion of the cutoff cam 100 and it allows rotation or pivoting of the cutoff cam 100 counterclockwise around the cam shaft 322. A second cam slot 324 disposed in the rear portion 102 of the cutoff cam 100 engages a tensioning spring engagement pin 114 which operatively connects the cutoff cam 100 (and its associated actuating assembly 21) to the selective tensioning adjustment assembly 25. Second cam slot 324 is elongated to allow the cam 100 to rotate around the cam pivot shaft 322. (FIG. 3A.)

A third cam slot 116 is formed in the forward end of the cam yoke 106 and provides a cam surface on each cam arm 104 and which includes two distinct cam surfaces 118 and 119. The first cam surface 118 generally comprises the rear portion of cam slot 116 (FIG. 3A) and forms a generally semi-circular depression 120 at the bottom of the cam slot 116. The second cam surface 119 is located adjacent to and forward of first cam surface 118 and has a generally planar surface forming a cam ramp 121 which begins approximately where the curvature of the first cam surface 118 ends. A rearward restraining force R is applied to the cutoff cam 100 via spring engagement pin 114 and restrains the cutoff cam 100 from rotating around the cam pivot shaft 322 when the trigger 20 is depressed until the preselected tension is attained in the tie operator is tensioning a cable tie 19. During the initial depression of trigger 20, the cam follower 94 remains in the semi-circular depressions 120 of the first cam surface 118. As the trigger is further depressed, the trigger 20 continues to pivot around a fixed point at the center of the bearing hub 86. When the tension in the tie 19 approaches the preselected tension, T, the trigger force applied by the operator applied to the trigger 20 exceeds the tension spring restraining force, R and the top portions of the two actuating links **72*a* and 72*b* pivot counterclockwise around the force fulcrum located at pivot pin 75 and the top of actuating links 72*a* and 72*b* instantaneously advance the cam follower 94 forwardly in a linear motion out the first cam surface depression 120 along the adjacent second cam surface 119. As the cam follower 94 moves forward, the cam follower 94 rides up the second surface cam ramp 121, rotating the cutoff cam 100 counterclockwise around its pivot shaft 322. The cam follower 94 then operatively engages a cutoff link 325 held between the cam arms 104 of cam yoke 106 and forces it downward and forward, which in turn causes rotation of a blade link 326 pivotally attached to the housing 11 by a pivot pin 74. The blade link 326 pivots clockwise and upward around pin 18, thereby bringing a tie-severing blade 128 upward into contact with the tie tail 18 and severing the tie tail 18 generally adjacent the cable tie head 24. Because the tension spring 130 constantly exerts a restraining force on the cutoff cam 100 during the tensioning and the movement of cam follower 94 from the first cam surface 118 to the second cam surface 119 is virtually instantaneous, the tie is severed flush with the tie head while under tension, thereby ensuring that the preselected tension value is attained in the tie 19**.

Selective Tensioning Assembly

The present invention also provides a selective tensioning assembly 25 which enables the operator to rapidly select one of a number of preselected tension levels in the tie by rotation of tension knobs 180 or 182. As explained above, the tensioning assembly 25 applies a rearward force on the cutoff cam 100 via the tension engagement pin 114 to restrain the cuttoff cam 100 from rotating forwardly around its pivot shaft 322. This restraining force is created in the tension spring 130 and transferred to the cutoff cam 100 by the engagement pin 114 held within the rear wall 102 of cutoff cam 100.

Figure 4:
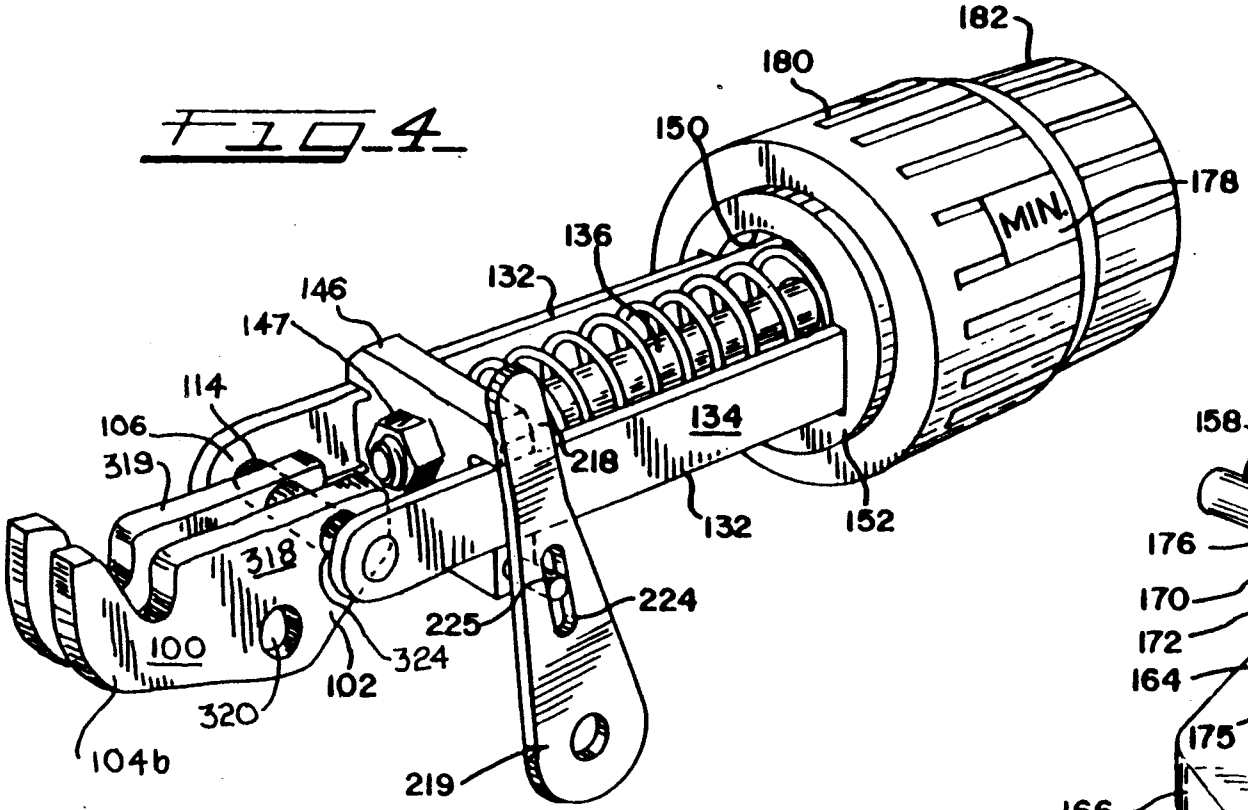
FIG. 4 is a perspective view of the tie tensioning mechanism used in the tool shown in FIGS. 1-3 with the lever arm shown on the left side thereof for clarity.

FIG. 4 shows a preferred embodiment of a selective tensioning assembly 25 which comprises a tension spring 130 held between two arms 132 of a U-bracket 134. The spring 130 encircles a tension shaft 136 axially disposed within the bracket arms 132. A tension engagement pin 114 joins the bracket arms 132 together at the front of the bracket 134, while the rear of the bracket includes an endplate 140 which has an generally cylindrical opening 138 to accommodate the passage therethrough of the tension shaft 136. The rear end of tension shaft 136 includes an enlarged diameter portion 142 (shown in phantom in FIG. 5) which abuttingly engages the back surface 165 of axial cam 164. Tension shaft 136 has a threaded portion 145 at its front end which threadedly engages a threaded tension nut 146. In the initial tool position (FIG. 1), the tension spring 130 is subjected to a slight preload or compression due to its placement between the tension nut 146 and the bracket endplate 140 (compressed approximately 0.060 inches from its free length). It will be seen that any rearward movement of the tension nut 146 on tension shaft 136 will increase the compression on spring 130, and increase the rearward or restraining force that the spring 130 exerts upon the cutoff cam 100.

Figure 5:
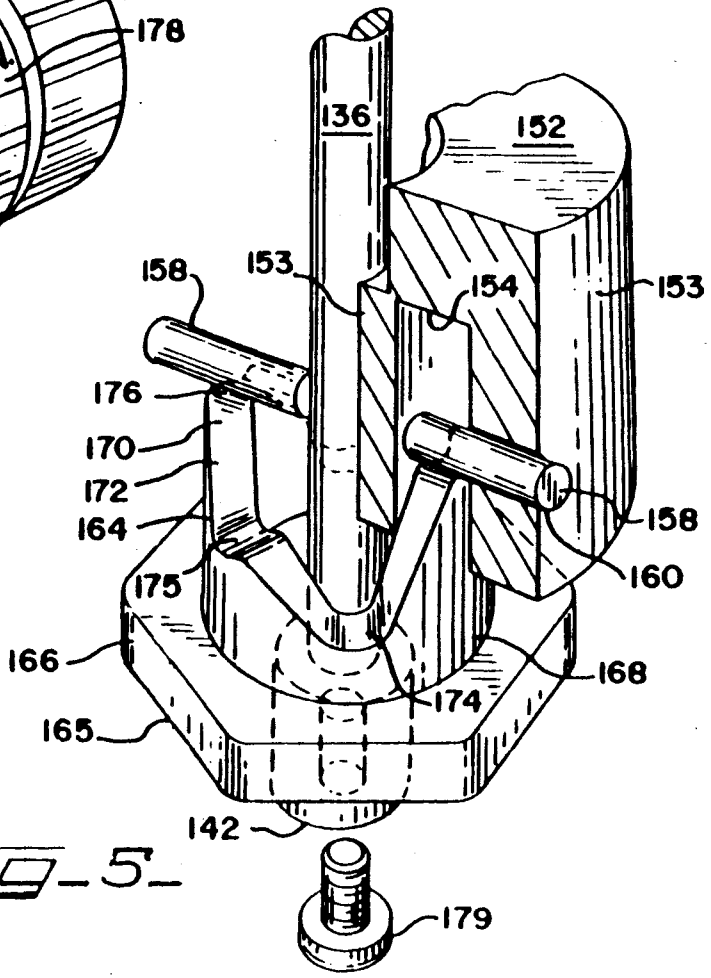
FIG. 5 is a cutaway perspective view of part of the tensioning mechanism of FIG. 4.

As best seen in FIG. 5, bracket 134 fits in a recess 150 of a fixed cam 152, this cam being fixed to the tool barrel 13 at the rear of tool housing 11. Fixed cam 152 includes two axially and generally cylindrical walls 153 which define an annular slot 154 therebetween which accommodates the cylindrical extension 168 of an axial cam 164. Two crosspieces 158 extend radially through the fixed cam outer wall 153 and are held in a fixed relationship to each other approximately 180° apart in two radial openings 160. These crosspieces 158 protrude into the fixed cam slot 154, and define a fixed point of engagement 160 on the tool 11 for the axial cam distinct cam surfaces 174, 175 & 176.

Figure 9A:
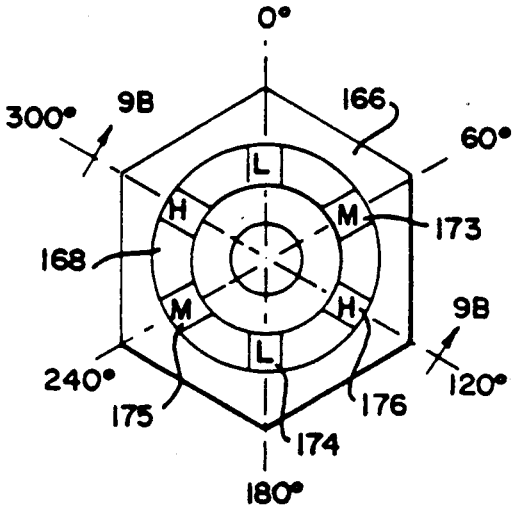
FIG. 9A is a plan view of the axial cam.
Figure 9B:
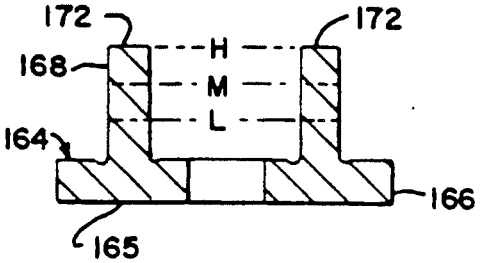
FIG. 9B is a sectional view taken along line B—B in FIG. 9A.
Figure 9C:
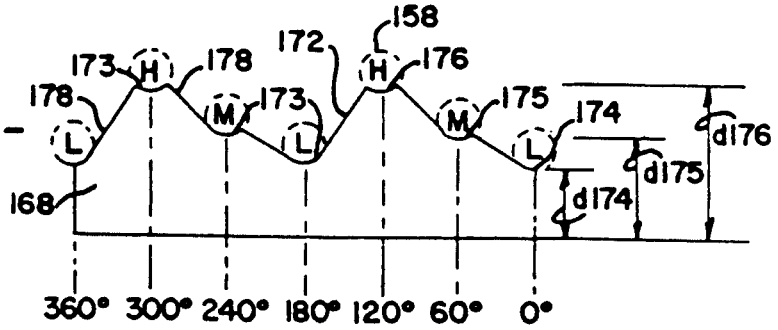
FIG. 9C is a diagram showing the profile of the cam surfaces of the axial cam of FIG. 9A.
Figure 8D:
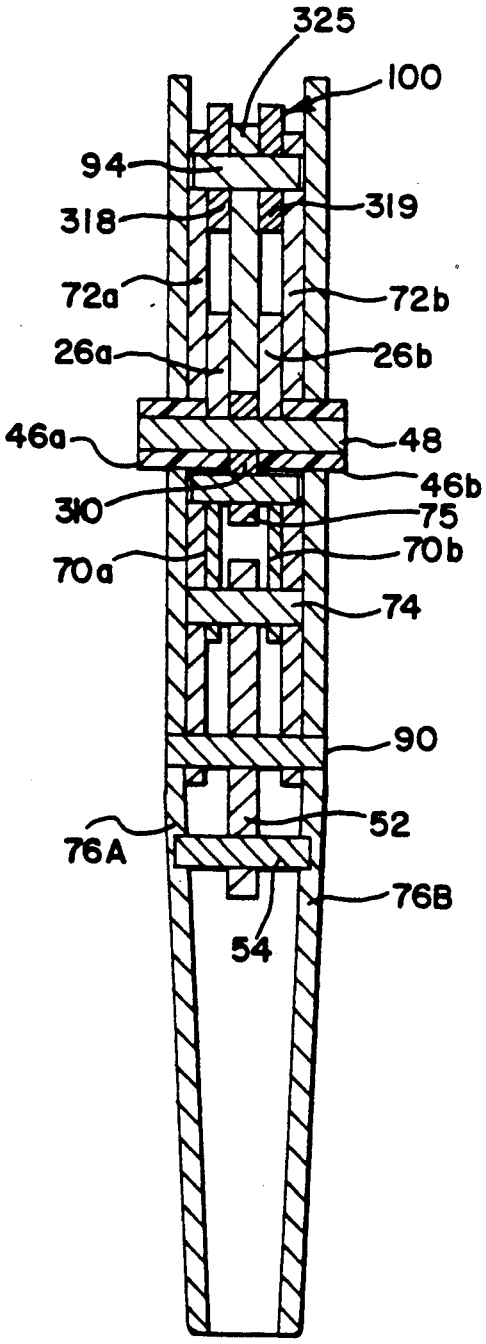
FIG. 8D is a sectional view taken along line D—D in FIG. 3.

The base 166 of axial cam 164 preferably has a noncircular configuration, (shown in FIG. 5 as a hexagon) so that it engagingly fits within a complimentary shaped recess (not shown) centered in the tension or cam knob 180 and provides a means of operative engagement between them such that the axial cam 164 rotates with tension knob 180 when the latter is turned by the tool operator. A generally cylindrical cam extension 168 extends axially outwardly from the cam base 166, the axial face of this extension 168 providing a generally circular cam surface 172. This axial cam surface 172 is further divided into pairs of cam surfaces, (FIGS. 5 & 9A–C) as three distinct pairs 174, 175 & 176 each pair having a different length of axial extent from the cam base 166, represented in FIG. 9C as $d_{174}$, $d_{175}$, and $d_{176}$. Individual depressions 173 are located at the ends of the cam surface pairs and are generally semi-circular in configuration. The depressions 173 engage the complimentary cylindrical configuration of the fixed crosspieces 158 and are spaced 180° apart from one another. Each pair of cam surfaces shown in the drawings are spaced 60° apart from their adjacent pair.

In operation, the compression of the tension spring is increased by the operator rotating the tension knob 180 which also rotates the axial cam 164. A pair of cam surface depressions 173 engage the crosspieces 158 to establish a preselected compression or preload of tension spring 130. Because the back 165 of axial cam 164 engages the enlarged diameter 142 of tension shaft 136, the tension nut 146 is drawn rearwardly toward the bracket endplate 140 (Which is fixed in its location in the fixed cam recess 150), a distance corresponding to the height of the cam surface chosen on the axial cam 164. When the first pair of axial cam surfaces 174 engage the crosspieces 158, the distance between the tension nut rear face 148 and the bracket endplate 140 is substantially at a maximum and thus the compression exerted on tension spring 130 is at a minimum setting. Turning the tension knob 180 either clockwise or counterclockwise to the next tension setting brings the next pair of cam surface depressions 173 into engagement on the fixed crosspieces 158, which increases the compression on spring 130 (and decreases the distance between the tension nut 146 and bracket endplate 140) by an amount equal to the extent of the axial cam pair. Increasing the compression in the tension spring 130 in this manner increases the restraining force applied to the cutoff cam 100 via engagement pin 114. Due to the 60:40 mechanical advantage described above, the tension spring force R is smaller and the torque required by the operator to rotate tension knob 180 (and hence increase the compression on tension spring 130) is reduced, thereby reducing operator fatigue. Visual indicators 178 may be affixed to the outer circumference of tension knob 180 to indicate to the operator which preselected tension value is chosen.

A second tension adjustment knob 182 is provided so that the operator has a means for finely adjusting or "fine-tuning" the tension values chosen by rotation of tension knob 180. Knob 182 is fixedly attached to the tension shaft 136 by means of a screw 179 which connects the fine adjustment knob 182 to shaft 136 (FIGS. 1–3) in the enlarged diameter shaft portion 142 so that the shaft 136 and knob 182 are co-rotatable. Thus, rotation of the tension shaft 136 moves the threaded tension nut 146 a slight distance forward or backward on the threaded shaft portion 145, dependent on the direction of rotation of knob 182. Shaft 136 extends axially through a common circular and coaxial opening in tension knob 180, axial cam 164 and the fixed cam 152 so that when shaft 136 is rotated by turning the fine adjustment knob 182, the shaft 136 does not rotatably engage either the tension knob 180 or the axial cam 164. The front shaft portion 145 is threaded for a limited distance only (by way of stop 147) to limit the extent of travel thereon by tension nut 146 and correspondingly limit the amount of fine adjustment in the compression of spring 130. By turning the fine adjustment knob 182, the operator can slightly increase or decrease the spring length between the tension nut 146 and the rear of U-bracket 112.

Figure 7:
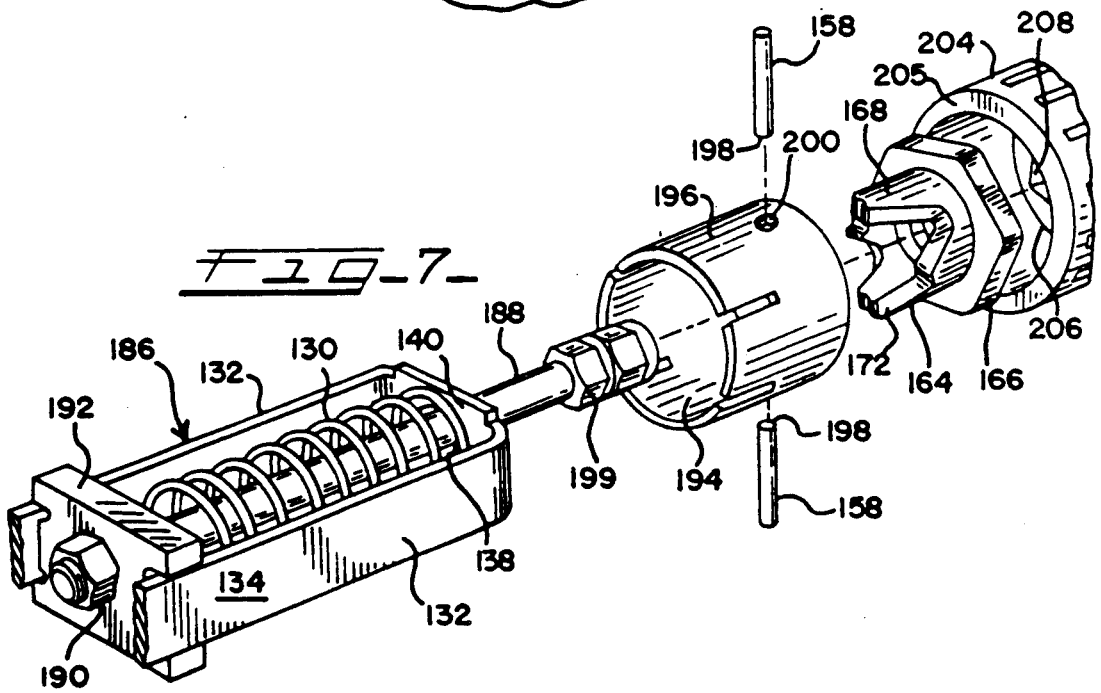
FIG. 7 is an exploded perspective view of a second embodiment of a tensioning mechanism constructed in accordance with the present invention.

A second embodiment of a tension assembly 186 constructed in accordance with the present invention is shown in FIG. 7. This embodiment is similar in construction to the preferred embodiment described above except that one knob 204 is used for adjustment of tension level and fine adjustment instead of two, and the cam knob 204 is keyed to the shaft 188. A moveable spring stop on the shaft 188 is provided by tension nut 190 which threadedly engages the shaft 188 between the bracket arms 132 when it moves along tension shaft 188. A nut 192 is fixed to the end of shaft 188 and provides a stop on shaft 188 to limits the travel of spring stop 192 on the shaft 188.

The tension spring 130 is held between the bracket endplate 140 and the spring stop 192, and this bracket-spring assembly is seated in a recess 194 of fixed cam 196. A pair of crosspieces 158 extend radially inwardly through the fixed cam 196 via radial openings 200, and as the fixed cam 196 has no annular slot 154 the ends 198 of the crosspieces 158 terminate near the tension shaft 188. These crosspieces provide a fixed point of engagement for the pairs of axial cam surfaces 174, 175 & 176. The axial cam 164 used in this embodiment is identical in all respects to the axial cam used in the preferred embodiment described above.

Only one tension adjustment knob 204 is provided in this second embodiment. Cam knob 204 has a non-circular recess 206 which engages the irregular (hexagonal) base 166 of the axial cam 164, and also has a central axial keyway 208 which engages shaft end nuts forming a shaft hex section 199 so that rotation of tension knob 204 turns both the axial cam 164 and shaft 188 to move the spring stop 190 on tension shaft 188 when the base 205 of the knob 204 abuts the rear of the tool housing 11. If only fine adjustment of the tension is desired, the operator can move cam knob 204 slightly rearwardly on shaft 188 to disengage the knob 204 from the axial cam base 166 and the rotation of cam knob 204 will only rotate the shaft 188 and not the axial cam 164, the knob 204 engaging the shaft hex section 199.

Tension Setting Visual Display Assembly

Figure 6A:
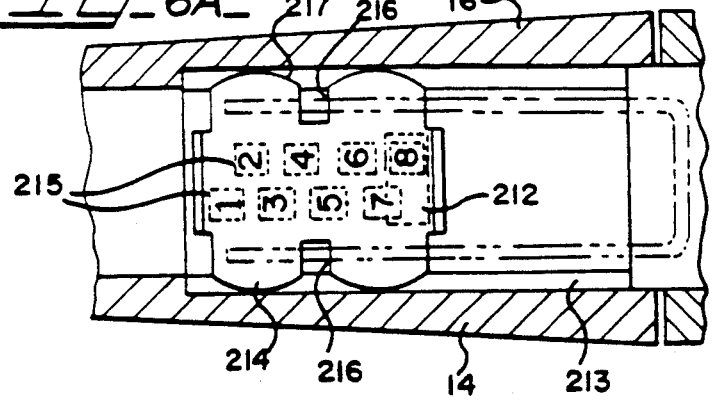
FIG. 6A is a plan view taken along line A—A in FIG. 6.
Figure 6:
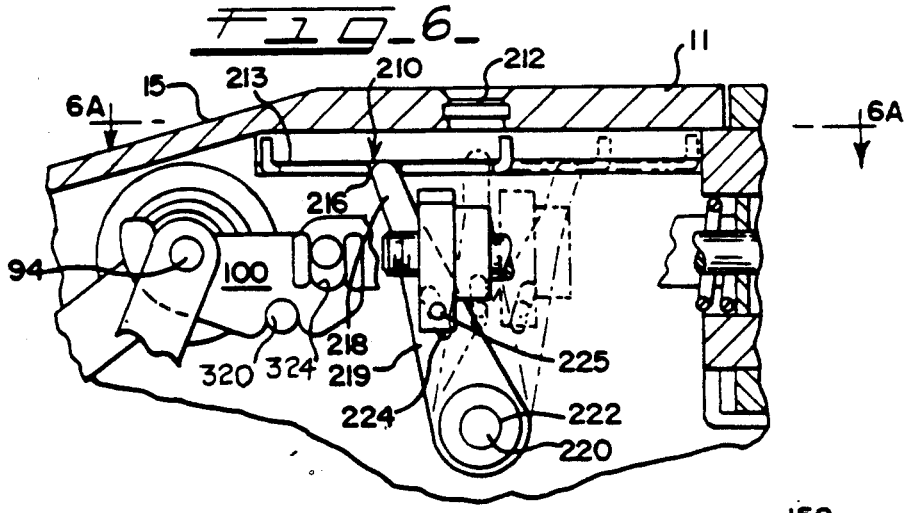
FIG. 6 is a fragmentary elevational view of the tool shown in FIGS. 1-3 showing the digital tension indicator and fine tensioning adjustment mechanism.

A means for visually indicating the adjustment level setting is shown generally as 210 in FIGS. 6–6A. A window 212 is provided in the top of the tool housing 11 over the tensioning assembly 25. Guide tracks 213 are formed in the housing sidewalls 14 & 15 and support a display plate 214 which is slideable on the tracks 213. The display plate 214 has a plurality of tension value indicating digits 215 thereon arranged in two vertical rows generally parallel to the longitudinal axis of the tool in which the individual digits in one row are vertically offset from the individual digits in the other row so that only one digit may fully appear through the window 212 at any one time. Each indicating digit 215 on the display plate 214 is approximately the same size as the housing window 212 so that the operator can dial one digit corresponding to a preselected tension value into view beneath window 212. Sliding display plate 215 is generally flat and has means for engaging the tensioning assembly 25 in the form of parallel notches 216 in the length 217 of display plate 214. These notches 216 engage fingers 218 of either one or a pair of indicator levers 219, which are attached to the housing sidewalls 14 & 15 by pivotal means shown in the Figures as a housing boss 220 engaged by a circular opening 222 at the lower end of indicator lever(s) 219.

Where one lever arm 219 is used, it can be located on either the right hand side of the tensioning assembly as illustrated in FIGS. 1–3 & 6, or on the left hand side thereof as shown in FIG. 4. At approximately the middle of the lever arm 219, an elongate slot 224 is provided to engage a pin 225 on the tension nut 146 which extends outwardly therefrom generally transverse to the tension shaft 136 and below the tensioning assembly U-bracket arms 132. It will be appreciated that by virtue of this connection, any movement of the tension nut 146 on the tension shaft 136 will move the indicator lever(s) 219 parallel to the tension shaft correspondingly slide the display plate 214 beneath the window 212, as shown in phantom in FIG. 6 to bring a different tension value indicating digit 215 into view in the window 212 to thereby indicate the tension value setting of the tool.

For example, when the tension knob 180 is rotated to set the axial cam 164 on its low position (where cam surface pair 174 engage the crosspieces 158), the digit "2" will substantially appear in the indicator window 212. Turning the tension knob 180 to the next intermediate position (where cam surface 175 engages the crosspieces) will cause the digit "4" to substantially appear in the window while turning the knob 180 once again engages cam surface 176 on the crosspieces in its high tension setting so that digit "7" substantially appears in the window 212. Turning the fine adjustment tension knob 182 in either direction so that the tension nut 146 advances its maximum distance either forward or backward on the shaft 136 will cause the two digits numerically adjoining the digit obtained from the tension knob 180 to substantially appear in the window 212. In the case of the low, intermediate and high tension settings mentioned above, the digits "1" or "3", "3" or "5", or "6" or "8" respectively will appear in the window 212, dependent on the direction of maximum rotation of knob 182. The maximum stroke of the display plate 214 (that is the travel distance between digits "1" and "8" appearing in display window 212) is approximately 0.630 inches. To effect this stroke the tension nut 192 travels a distance of approximately 0.296 inches on the tension shaft 136. A 2:1 movement multiplier for the tool is thereby attained, which allows the size of indicating digits 215 to be increased for greater visibility to the tool operator.

Operation of the Tool

In operation, a cable tie tail 18 is inserted into the nose slot 32 with the tool at its normal, initial position (FIG. 1) with the tie head 24 positioned adjacent the nose slot 32. The three angled surfaces 302, 305 and 308 cooperate to orient the tie tail 18 upwardly. As the trigger 20 is depressed by the operator toward the handle 12 the trigger links **76*a* & 76*b* and the actuating links 72*a* & 72*b* rotate around the center of the bearing hubs 86, while the cam follower 94 slightly rotates in the first cam surface depression 120. The pawl links 26 are drawn rearwardly, sliding in the guide tracks 50 and causing the handle link 52 and the two short links 70*a* & 70*b* to pivot about their respective pivot pins. As the tension on the pawl links 26 increases due to the closing of the cable tie loop around the bundle of wires 34, a force equal to the tension in the tie (the tie input force, F) is translated through the high tension link 310 to the pivot point 75 of the actuating links 72*a* & 72*b* which serves as the fulcrum for operation of the cutoff cam 100 by the actuating links 72*a* & 72*b*. Two rearward forces act to oppose this tie input force. One force, T, is created by the operator depressing the trigger 20 and is transmitted from the trigger 20 to the actuating link trigger pivot pin 90. The second force is the restraining force, R, supplied by the tension spring 130 which applies a rearward force on the cutoff cam 100 through the axial cam 164, the fixed cam 152 and the U-bracket 134**. A balance is established when the total rearward forces T and R equal the forward force F. At this equilibrium point the severing mode of the tool begins. (FIG. 3.)

The severing mode begins when the operator-applied trigger force exceeds the restraining force supplied by the tension spring and presented through the 60:40 mechanical advantage found on the actuating links **72*a* & 72*b*. At this instant, the pair of actuating links 72*a* & 72*b* act as if they are a single beam supported on a fulcrum (pivot point 90) with the restraining force R pulling one end of it rearward at cam follower 94 and the trigger force T pulling the other end rearward at trigger pivot pin 90. As the trigger force T exceeds the tension spring restraining force R, the pair of actuating links 72*a* & 72*b* (the beam) will pivot counterclockwise around its pivot point 90 and the top of those links will move forwardly while the trigger 20 maintains its fixed pivotal axis around the center of the bearing hub 86. The cam follower 94 is urged out of the first cam surface depression 120 by the pivoting of actuating links 72*a* & 72*b* to the cam ramp 121 of the second cam surface 119 and moves linearly thereon (FIG. 3A). The movement of cam follower 94 causes the cutoff link 325 to move forwardly and downwardly, thereby causing the blade link 326 to rotate around pivot pin 74 to move the blade 128 upward to sever the tie tail 18. After severing the tie tail 18, the operator releases the pressure on the trigger 20 and the handle return spring 58 forces the pawl links 26 forwardly to the nose guide block 39, so that the pawl front face 301 engages and moves along the nose block depression 300, thereby opening the tie passageway 41 of the pawl links 26** and allowing the severed tie tail to fall to waste. Due to this unique mechanical linkage arrangement, the tool gives reliable and consistent tensioning of ties with tension valves between 9 and 55 pounds and clean, flush severing results.

While the preferred embodiments of the invention have been shown and described, it will be obvious to those skilled in the art that changes and modifications may be made therein without departing from the spirit of the invention, the scope of which is defined by the appended claims.

What we claim is:

1. A tool for tensioning and severing an elongate cable tie having a tie head portion and tie tail portion comprising, means for gripping and tensioning the tail of the cable tie capable of reciprocating linear movement, including a rotatable pawl adapted to engage the cable tie tail and apply pressure to said cable tie tail so that it is pressed against a tie guide plate formed on said tie gripping and tensioning means, means for severing said cable tie tail from said cable tie head upon attainment of a preselected tension in said tie, actuating means for actuating said tensioning means and being capable of pivotal and linear movement, said actuating means being operatively connected to said severing means and said tie tensioning means, restraining means for restraining said actuating means to pivotal movement until a preselected tension is achieved in said cable tie tail by said tensioning means, whereupon said actuating means moves linearly to actuate said severing means and sever said tie tail from said tie head, and means for positioning said tie tail in contact with said pawl, the positioning means including a first angled surface of said tie tool which directs said cable tie tail upwardly at a preselected angle and a second angled surface disposed on said tie guide plate which also directs said cable tie tail upwardly in cooperation with said first angled surface.

2. The tool of claim 1, further including rotatable means for selectively adjusting the tension attained in said cable tie tails, the selective tension adjusting means including first rotatable means for selectively changing the restraining force in preselected values to cause a corresponding change in the level of tension attained in said cable tie tail and second rotatable means for causing selective fine adjustment of the restraining force with respect to each of said first means preselected tension values.

3. The tool of claim 2, further including visual indicating means for visually indicating the preselected tension level chosen by the operator, comprising slideable display means operatively connected to said first and second rotatable means to indicate the preselected tension value setting of said first and second rotatable means.

4. The tool of claim 2, wherein said selective tension adjusting means further includes fixed cam means, rotational cam means operatively connected to said first rotatable means, said rotational cam means operatively engaging said fixed cam means at a fixed point thereon, threaded shaft means axially disposed within said rotational cam means said first and second rotatable means, said shaft means having stop means moveably disposed at one end of said shaft, spring means axially disposed on said tension shaft means between said fixed cam means and said shaft stop means, said spring means exerting a restraining force upon said actuating means.

5. The tool of claim 1, wherein said actuating means includes cam means operatively connected to said restraining means and said severing means.

6. The tool of claim 3, wherein said cam means includes a cam surface and a cam follower operatively connecting said actuating means to said severing means and to said cam means, said cam surface including a first cam surface which allows pivotal movement thereon by said cam follower and a second cam surface adjacent said first cam surface which allows linear movement therein by said cam follower.

7. The tool of claim 4, wherein said restraining means further includes a spring applying a restraining force on said cam means to prevent movement thereof until a preselected tension is achieved in said cable tie.

8. The tool of claim 1, further including a housing having first guide means thereon for guiding said tensioning means in said reciprocating linear movement, a linkage operatively connecting said tensioning means with said actuating means, the operative connection of said tensioning and actuating means being disposed on said linkage within said guide means, said tensioning means further including roller bearing means slideably engaging said first guide means.

9. The tool of claim 1, wherein said actuating means includes an actuator and cam means operatively connected both to said actuator and said severing means by a cam follower, said cam means having a generally arcuate first cam surface which allows pivotal movement of said cam follower thereon and a generally planar second cam surface adjacent said first cam surface which allows linear movement of said cam follower thereon, said cam follower being restrained to pivotal movement on said first cam surface by said restraining means until said preselected cable tie tension is attained, whereupon said actuator moves said cam follower linearly from said first cam surface to said adjacent second cam surface, thereby bringing said cam follower into operative engagement with said severing means and actuating said severing means.

10. 9. The tool of claim 8, wherein said actuator is operatively connected to said tensioning means by linkage means.

11. The tool of claim 1, further including trigger means operatively connected to said actuating means and linkage means operatively connecting said trigger means and said actuating means to said tensioning means.

12. The tool of claim 10, wherein said linkage means is operatively connected to said actuating means between said actuating means-trigger operative connection and said actuating means-severing means operative connection and wherein said linkage means is operatively connected to said tensioning means between said actuating means-trigger operative connection and said actuating means-severing means operative connection.

13. The tool of claim 1, wherein said rotatable pawl contains a plurality of spaced apart tie gripping teeth, the tie gripping teeth further being angled upwardly from said pawl, said first and second angled surfaces directing said cable tie tail into a preselected orientation to said pawl, said teeth having a depth sufficient to enable said pawl teeth to grip a flat or serrated surface of said cable tie tail.

14. A tool for tensioning and severing an elongate cable tie having a tie head portion and tie tail portion comprising, means for gripping and tensioning the tail of the cable tie capable of reciprocating linear movement, means for severing the cable tie tail from said cable tie head when a preselected tension is attained in said tie, means for actuating said tensioning and severing means, said actuating means being operatively connected to said severing means and said tie tensioning means, restraining means for restraining said actuating means from operating said severing means until a preselected tension is achieved in said cable tie tail by said tensioning means, whereupon said actuating means urges said severing means to sever said tie tail from said tie head, first linkage means operatively connecting said actuating means to said tensioning means, second linkage means operatively connecting said actuating means to trigger resistance means disposed within said took handle, said first linkage means being disposed generally above said second linkage means, and selective tension adjusting means for selectively adjusting the preselected tension attained in said tie tail, including first rotatable means for selectively changing the restraining force in preselected values to cause a corresponding change in the level of tension of said cable tie tail and second rotatable means for causing selective fine adjustment of the restraining force with respect to each of said first means preselected tension values.

15. The tool of claim 14, wherein said actuating means includes cam means operatively connected to said restraining means and said severing means, said cam means including a cam surface and a cam follower operatively connecting said actuating means to said severing means and to said cam means, said cam surface including a first cam surface thereon allowing pivotal movement thereon by said cam follower and a second cam surface thereon adjacent said first cam surface allowing linear movement thereon by said cam follower.

16. The tool of claim 14, wherein said restraining means further includes a spring applying a restraining force to said cam means to prevent the movement thereof until a preselected tension is achieved in said cable tie.

17. The tool of claim 14, wherein said trigger resistance means further includes a spring applying a resistance force to said tensioning means and a trigger.

18. The tool of claim 14, further including visual indicating means for visually indicating the preselected tension value chosen by the operator, comprising slideable display means operatively connected to said first and second rotatable means to indicate the preselected tension value setting of said first and second rotatable means.

19. The tool of claim 14, wherein said selective tension adjusting means further includes fixed cam means, rotational cam means operatively connected to said first rotatable means, said rotational cam means operatively engaging said fixed cam means at a fixed point thereon, threaded shaft means axially disposed within said rotational cam means said first and second rotatable means, said shaft means having stop means moveably disposed at one end of said shaft, spring means axially disposed on said tension shaft means between said fixed cam means and said shaft stop means, said spring means exerting a restraining force upon said actuating means.

20. The tool of claim 14, further including trigger means operatively connected to said actuating means, the operative connection between said first linkage means and said tensioning means being located between the operative connection between said trigger means and said actuating means and the operative connection between said actuating means and said severing means.

21. The tool of claim 20, wherein the point of operative connection between said first linkage means and said actuating means occurs at approximately 40% of the distance from said actuating means-trigger means operative connection to said actuating means-severing means operative connection.

22. A tool for tensioning and severing an elongate cable tie having a tie head portion and tie tail portion comprising, means for gripping the cable tie tail in the form of a pawl and applying pressure on said cable tie tail during operation of said tool, means for tensioning the cable tie tail capable of reciprocating linear movement, means for severing the cable tie tail from said cable tie head when a preselected tension is attained in said tie, actuating means for actuating said tensioning and said severing means and being capable of pivotal and substantially linear movement, said actuating means being operatively connected to said severing means and said tie tensioning means, restraining means for restraining said actuating means to pivotal movement until a preselected tension is achieved in said cable tie tail by said tensioning means, whereupon said actuating means moves linearly to actuate said severing means and sever said tie tail from said tie head, means for positioning said tie tail in said tool in contact with said tie gripping means, means for releasing the tie gripping pressure of said pawl on a severed cable tie tail including a first interactive surface disposed on said tool and a second interactive surface disposed in said gripping means, the first interactive surface having a generally arcuate surface, the second interactive surface also having a generally arcuate surface, said first and second interactive surfaces being complementary in configuration to each other and further being disposed along a common longitudinal axis of said tool, whereby said first and second interactive surfaces cooperate to rotate said pawl and release the severed cable tie tail therefrom, and, slideable display means operatively connected to said restraining means.

23. The tool of claim 22, wherein said actuating means includes an actuator and cam means operatively connected to said actuator and said severing means by a cam follower, said cam means including a first, generally arcuate cam surface which allows pivotal movement of said cam follower thereon and a second, generally planar cam surface adjacent said first cam surface which allows linear movement of said cam follower thereon, said cam follower being restrained to pivotal movement on said cam means by said restraining means until said preselected cable tie tension is attained, whereupon said actuator urges said cam follower from said first cam surface to said second cam surface, thereby bringing said cam follower into operative engagement with said severing means and actuating said severing means.

24. The tool of claim 22, wherein said selective tension adjusting means further includes fixed cam means, rotational cam means operatively connected to said first rotatable means, said rotational cam means operatively engaging said fixed cam means at a fixed point thereon, threaded shaft means axially disposed within said rotational cam means said first and second rotatable means, said shaft means having stop means moveably disposed at one end of said shaft, spring means axially disposed on said tension shaft means between said fixed cam means and said shaft stop means, said spring means exerting a restraining force upon said actuating means.

25. The tool of claim 22, wherein said actuating means is operatively connected to trigger means beneath a linkage operatively connecting said tensioning means to said actuating means, said linkage means increasing the moment arm about the actuating means-trigger means operative connection.

26. The tool of claim 22, further including trigger means operatively connected to said actuating means and linkage means operatively connecting said tensioning means to said actuating means, the operative connection between said linkage means and said actuating means being between the operative connection of said trigger means and said actuating means and the operative connection of said actuating means and said severing means.

27. The tool of claim 22, wherein said tie tail positioning means cooperates with a plurality of angled tie gripping teeth disposed on a surface of said pawl to permit said tie gripping teeth to grip a flat surface or a serrated surface of said cable tie tail.

28. In a tie tool for tensioning and severing an elongate cable tie having a tie head portion and a tie tail portion, said tool including means for gripping and tensioning the cable tie, means for severing the cable tie tail from the tie head portion upon the attainment of a preselected tension in said tie, and means for actuating both said tensioning means to tension said tie and said severing means to sever said tie when said preselected tension is achieved in said tie, means for positioning a cable tie for severing by said tool comprising a first angled surface located on said tool, a second angled surface located on said tensioning means, said first and second angled surfaces cooperating to position said cable tie tail angularly upwardly when inserted into said tool for tensioning.

29. The cable tie positioning means of claim 28 wherein said first angled surface includes a nose block having an upwardly angled ramp located thereon and said second angled surface includes a tie guide plate overlying said pawl, said tie guide plate being disposed generally parallel to said ramp.

30. The cable tie positioning means of claim 29, further including a third angled surface disposed above said ramp and forward of said second angled surface, said third angled surface having approximately the same angle as said second angled surface.

31. In a tie tool for tensioning and severing an elongate cable tie having a tie head portion and a tie tail portion, said tool including a pawl for gripping the cable tie during the tensioning thereof and means for tensioning said cable tie capable of reciprocating linear movement, means for severing the cable tie tail from the tie head portion upon the attainment of a preselected tension in said tie, and means for actuating both said tensioning means to tension said tie and said severing means to sever said tie when said preselected tension is achieved in said tie, and means for releasing said cable tie from said pawl comprising a first interactive surface disposed in the nose of said tool and in the path of said reciprocating tensioning means, the first interactive surface including a generally arcuate depression, a second interactive surface disposed on said pawl, said first and second interactive surfaces contacting each other on the return stroke of said tensioning means said contact between said two interactive surfaces rotating said pawl to release pressure applied by said pawl to said cable tie tail.

32. The tie releasing means of claim 31, wherein said first interactive surface is generally complementary to said second interactive surface, said first interactive surface including a leading edge which engages said second interactive surface, thereby urging said pawl to rotate rearwardly.

33. A tool for tensioning and severing an elongate cable tie having a tie head portion and tie tail portion comprising, means for gripping and tensioning the tail of the cable tie capable of reciprocating linear movement, the gripping means including a rotatable pawl adapted to engage the cable tie tail, means for severing said cable tie tail from said cable tie head upon attainment of a preselected tension in said tie, actuating means for actuating said tensioning means, the actuating means being operatively connected to said severing means and said tie tensioning means, first linkage means operatively connecting said tensioning means to said actuating means, means for returning said actuating means and said tensioning means to an initial position after said cable tie has been tensioned and severed, second linkage means operatively connecting said returning means to said actuating means, restraining means for restraining said actuating means to pivotal movement until a preselected tension is achieved in said cable tie tail by said tensioning means, whereupon said actuating means actuates said severing means and sever said tie tail from said tie head.

34. The tool of claim 33, further including trigger means operatively connected to said actuating means, said trigger means engaging a housing of said tool to permit rotation of said trigger means around a fixed point on the tool housing.

35. The tool of claim 34, wherein said first linkage means is disposed above said second linkage means such that the distance between the trigger-means actuating means operative connection and the first linkage means is greater than the distance between the trigger means actuating means operative connection and the second linkage actuating means operative connection.

36. The tool of claim 34, wherein said first linkage means is disposed generally forwardly of said returning means.

37. The tool of claim 34, further including means for positioning said tie tail in contact with said rotatable pawl, the tie positioning means including at least two angled surfaces disposed in close proximity to said cable tie, said at least two angled surfaces cooperating to urge said cable tie tail upwardly when inserted into said tool.

38. The tool of claim 37, wherein said tie positioning means includes a first angled surface disposed on said tie tool, a second angled surface disposed on said tie tensioning means, said first and second angled surfaces cooperating to urge said cable tie upwardly away from said tool.

39. The tool of claim 37, wherein said rotatable pawl includes a plurality of angled teeth spaced apart on a surface of said pawl in a cable tie tail gripping orientation, said pawl teeth having a depth and sharpness sufficient to enable said teeth to grip a flat or serrated surface of said cable tie tail.

40. The tool of claim 34, further including means for releasing a severed cable tie tail from said rotatable pawl, the tie tail releasing means including a first interactive surface disposed on said tool and a second interactive surface disposed on said pawl, said first and second interactive surfaces engaging each other to rotate said pawl and release said severed cable tie tail therefrom.

* * * * *